United States Patent [19]

Van Bilderbeek

[11] 4,260,022

[45] * Apr. 7, 1981

[54] THROUGH THE FLOW-LINE SELECTOR APPARATUS AND METHOD

[75] Inventor: Bernard H. Van Bilderbeek, Aberdeen, Scotland

[73] Assignee: Vetco, Inc., Ventura, Calif.

[ * ] Notice: The portion of the term of this patent subsequent to Jan. 9, 1996, has been disclaimed.

[21] Appl. No.: 944,714

[22] Filed: Sep. 22, 1978

[51] Int. Cl.[3] ..... E21B 34/04

[52] U.S. Cl. ..... 166/339; 166/70; 166/75 A; 166/368; 166/366

[58] Field of Search ..... 166/338, 339, 340, 341, 166/344, 366, 362, 75 A, 70; 285/26, 137 A, 28, DIG. 21

[56] References Cited

U.S. PATENT DOCUMENTS

| | | | |
|---|---|---|---|
| 3,321,217 | 5/1967 | Ahlstone | 166/340 X |
| 3,542,125 | 11/1970 | Sizer | 166/368 |
| 3,545,474 | 12/1970 | Brown | 166/70 |
| 3,545,541 | 12/1970 | De Vries | 166/368 |
| 3,633,667 | 1/1972 | Falkner | 166/306 |
| 4,036,295 | 7/1977 | Kirkland | 166/344 |
| 4,126,183 | 11/1978 | Walker | 285/26 |
| 4,133,418 | 1/1979 | Bilderbeek | 137/874 |

FOREIGN PATENT DOCUMENTS

| | | | |
|---|---|---|---|
| 2004341 | 3/1979 | United Kingdom | 285/DIG. 21 |

*Primary Examiner*—William F. Pate, III

*Attorney, Agent, or Firm*—Subkow and Kriegel

[57] ABSTRACT

A through the flowline or "TFL" tool selector has a base provided with a number of spaced flowline ports and a diverter tube shiftably mounted in a housing for selective communication with the flowline ports. The base is mounted on a remotely operable connector, and the assembly is lowered onto a template beneath the sea having conduits aligned with the selector ports when the assembly is connected to the template. The inlet conduit loop of the selector assembly is also connected to an inlet conduit on the template. The connector is remotely operated to mechanically lock the selector apparatus in place.

29 Claims, 6 Drawing Figures

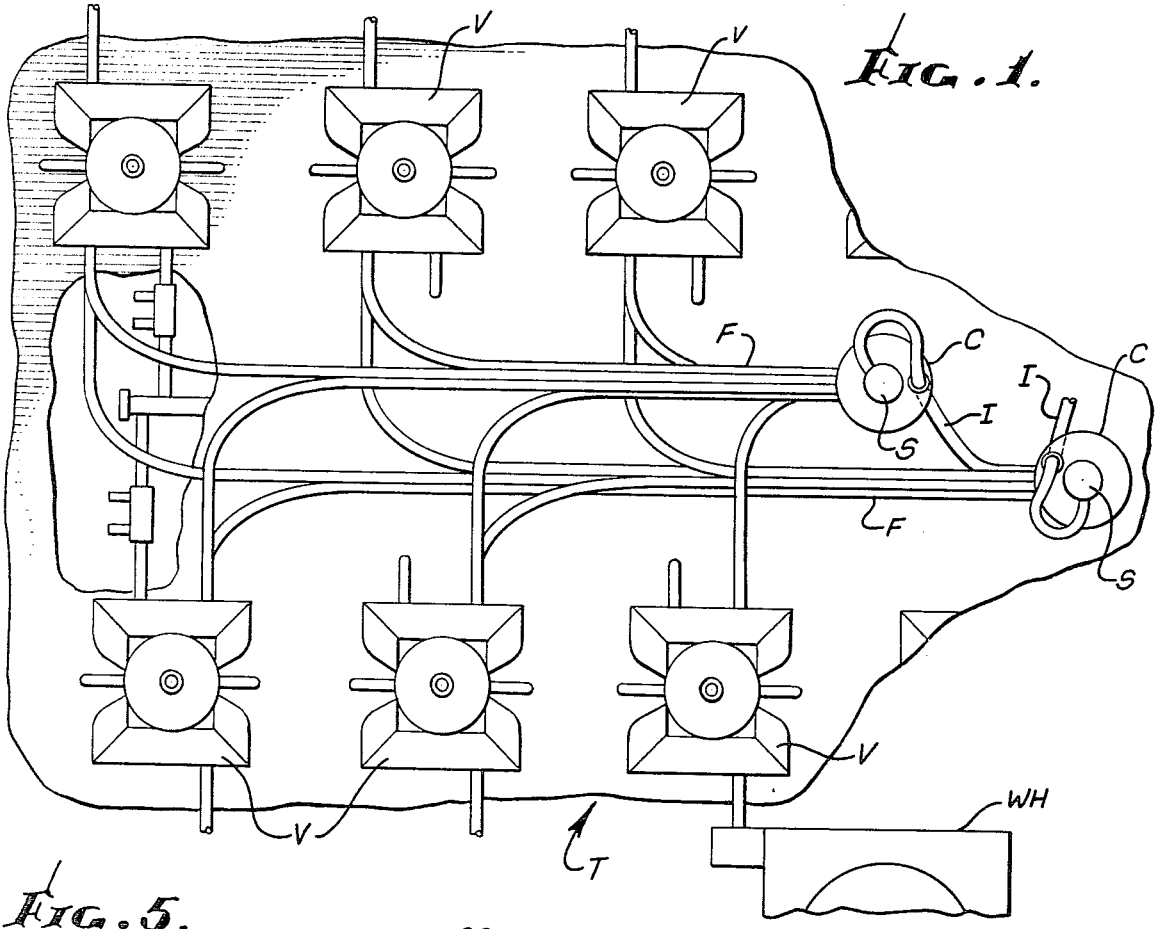
FIG. 1.
FIG. 5.
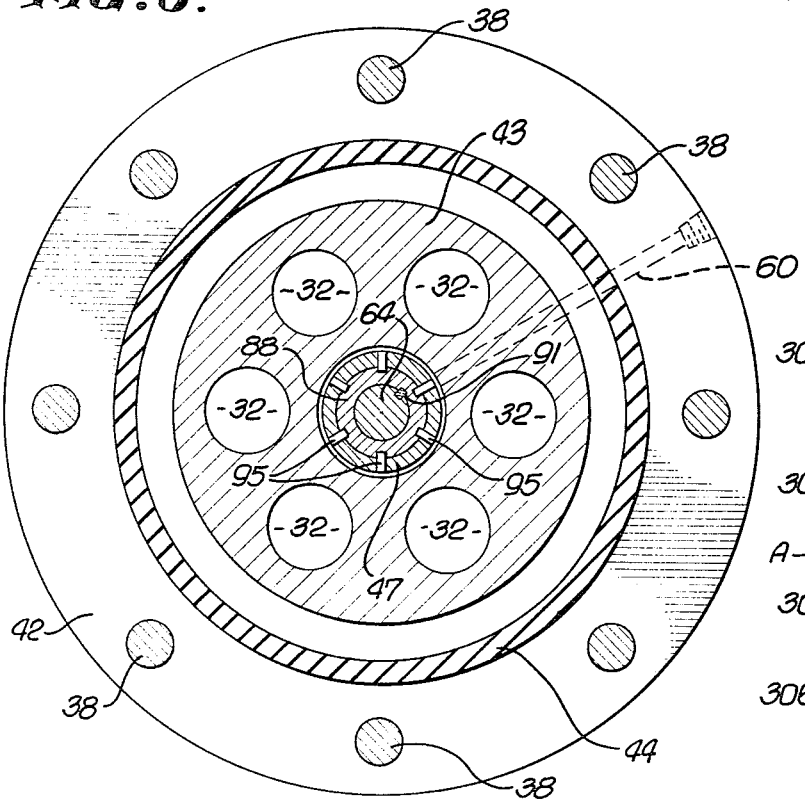
FIG. 6.
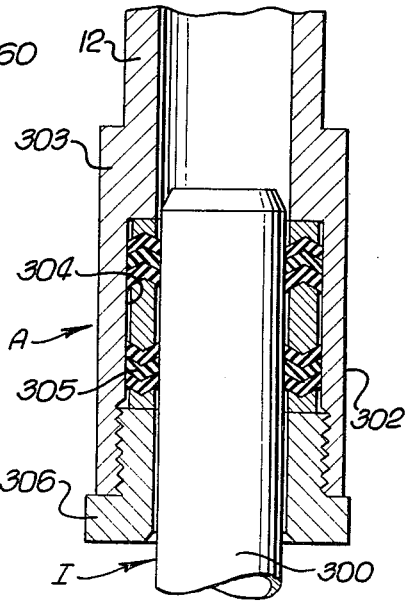

THROUGH THE FLOW-LINE SELECTOR APPARATUS AND METHOD

In the production of wells, such as oil and gas wells, it has become the practice to provide wellhead or control assemblies on templates, such as primary or secondary production templates which may be remotely located. Multiple wellheads are employed on such remote templates for controlling multiple wells or multiple completions. Such remote templates are commonly used, for example, in underwater well completions.

In order to perform various maintenance or other operations in the wells or in multiple zones of a well, it has become the practice to employ various tools which can be pumped into and from the wells through the flowlines, such practice being generally referred to as "TFL" operations and the tools being referred to as "TFL" tools.

In order to cause the tools to be directed into or from a tubing in a given well of a group or into a given tubing of a well completed with a plurality of tubings, remote tool diverters or flowline or tubing selectors have evolved. Such diverters, in general, have comprised a diverter tube which is adapted to conduct fluid through the assembly and direct the tools to a selected one of a number of flowline ports which communicate with the various well tubings or flowlines. One such "TFL" selector is shown in my pending application for U.S. Patent, Ser. No. 814,104, filed July 8, 1977 now U.S. Pat. No. 4,133,418, granted Jan. 9, 1979.

The installation, service or repair of the TFL selectors in subsea completions is costly, requiring divers or remotely controlled manipulators for making up or breaking connections. In the case of very deep water, the use of divers may not be feasible.

Accordingly there has existed a need for subsea TFL apparatus which can be easily installed on and removed from a subsea template, without requiring divers or subsea manipulators.

The present invention provides a TFL selector and connector mechanism whereby a TFL selector can be installed on or removed from a subsea template in a simple and effective manner.

More particularly, the invention provides a TFL selector and connector apparatus which is remotely operable for installation and removal by hydraulic means which mechanically lock the assembly to the template. In accomplishing this, a single high pressure inlet connection and a plurality of outlet connections are established when the connector is activated and locked. Remote operation of the TFL selector can then establish communication between the inlet and a selected outlet. Plural selectors may be employed for directing TFL tools to selected lines of a plurality of subsea wellheads.

In use, an assembly comprising a TFL selector, having an inlet or access loop, is combined with one part of a subsea connector unit, and the complemental part of the connector unit and an inlet fitting are combined with the template which also has a plurality of outlet conduits leading to selected wellheads, and, if desired, to another TFL inlet. The body of the connector part which is combined with the selector has plural passages which are aligned with the outlets provided on the template upon making up the connector.

A handling funnel is provided on the selector and connector section of the apparatus, enabling it to be run or lowered through a body of water on a tool at the lower end of a length of pipe and activated into locked relation to the connector part on the template. In some cases the selector and connector section may be guided by guidelines extending from the template to a platform or vessel at the top of the water while in other cases the selector and connector section may be run and rertrieved without guidelines.

In a more specific sense, the connector parts enable the running and retrieval of the TFL selector in a vertical manner, that is, by simply lowering and raising the selector and connector structure without requiring lateral movement of the subassembly during connection with the template.

This invention possesses many other advantages and has other purposes which may be made more clearly apparent from a consideration of forms and methods embodying the invention. These forms and methods are shown and described in the present specification and in the drawings accompanying and constituting a part thereof. They will now be described in detail, for the purpose of illustrating the general principles of the invention; but it is to be understood that such detailed description is not to be taken in a limiting sense.

Referring to the drawings:

FIG. 1 is a fragmentary plan view, showing a plurality of subsea TFL selectors in position on a subsea production template for a plurality of wells completed on the floor of the sea;

FIG. 5 is a transverse section on the line 5—5 of FIG. 3; and

FIG. 6 is an enlarged fragmentary vertical section on the line 6—6 of FIG. 2.

Figure 2:
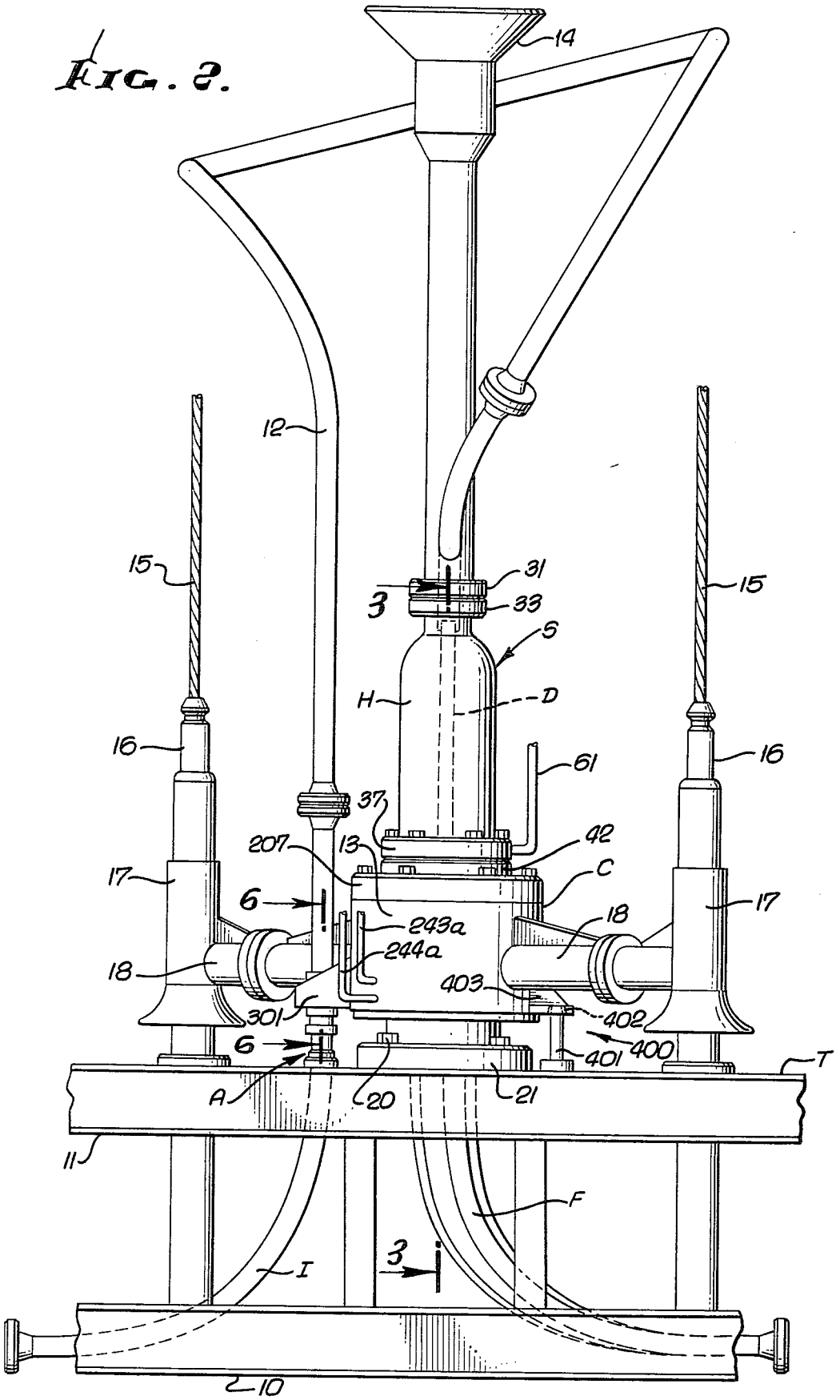
FIG. 2 is an enlarged elevation, showing a TFL selector and connector installed on the subsea template.

As seen in the drawings, a subsurface or subsea template structure T has thereon a plurality of valve units V for controlling flow of fluid to and from wellheads WH, only one of which is shown, whereby a plurality of wells completed on the ocean floor are produced and controlled. From time to time, in order to perform various maintenance or workover operations in the wells or in multiple zones of one of the wells, through the flowline or TFL tools are selectively pumped into and from the wells through flowlines F, leading from one or more through the flowline or TFL selector devices S, which according to the present invention are connected to the subsurface template structure by releasable and remotely operable connector means C. A pair of the TFL selectors S are connected to the template T by the respective connectors C, each selector and connector structure having an inlet flowline I. The selectors S are connected together, so that one of the inlet conductors I from one of the selectors S leads to the other selector S, and the respective flowlines or outlet conduits F lead from the respective selectors to the respective valve units, to enable the performance of the various maintenance or other operations in the respective wells or in multiple zones of the respective wells. As seen in FIG. 2, the template structure T has a base 10 adapted to be disposed upon the floor of the ocean or other body of water. Above the base 10 is an upper template structure 11, on which the connector C is made up with the selector S vertically disposed. The inlet or access conduit 12 which extends upwardly and arcuately in a loop to enable the free movement of the TFL tools therethrogh, the access loop 12 extending into the upper end of the selector apparatus S. The connector C includes a female or upper connector 13 on which the TFL selector S is mounted, and a handling funnel structure 14 extends upwardly from the top of the TFL selector for engagement by a suitable releasable running tool, which as well known, is adapted to be releasably connected to the upper end of the funnel structure 14, whereby the selector S and the connector section 13 is, as a subassembly, adapted to be lowered on a length of drill pipe or tubular conduit from a vessel or platform at the top of a body of water. As seen in FIG. 2, the template T has guidelines 15 extending upwardly from guideposts 16, whereby the connector and selector structure is adapted to be lowered as well as to be raised on the guidelines 15, with guide tubes 17 supported on radial arms 18 projecting outwardly from the connector body structure 13 disposed about the guidelines and adapted for engagement upon the posts 16, as is well known in connection with the drilling and completion of wells on the ocean floor.

Figure 3:
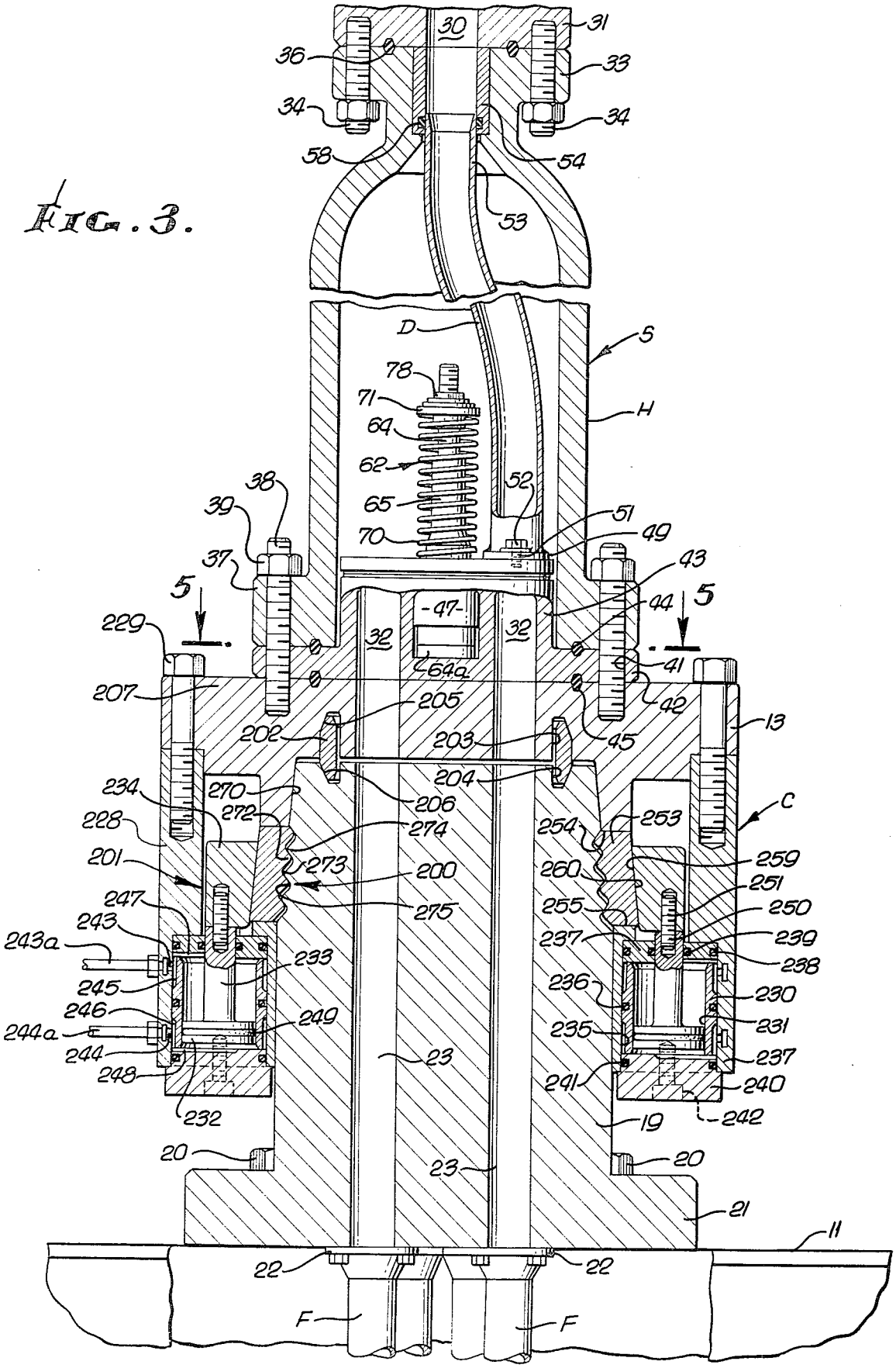
FIG. 3 is an enlarged, fragmentary vertical section, as taken on the line 3—3 of FIG. 2.

As seen in FIG. 3, the connector C also includes a male or inner connector body section 19 which is affixed to the upper template structure 11 as by means of suitable fastenings 20 extending through a base flange 21 on the connector body section 19 and into the template structure. The flowlines F have flanged connections 22 bolted to the connector body section 19 in alignment and in communication with a corresponding number of flow passages 23 which extend longitudinally through the connector body section 19 and to which TFL tools are adapted to be supplied selectively in response to operation of the TFL selector S.

The TFL selector S may be of any suitable type adapted to be remotely controlled to selectively effect the movement of the TFL tools through the connector passages 23, but in the illustrated embodiment, the TFL selector S is the selector more particularly disclosed and claimed in my above-identified copending application for U.S. patent, now U.S. Pat. No. 4,133,418.

Figure 4:
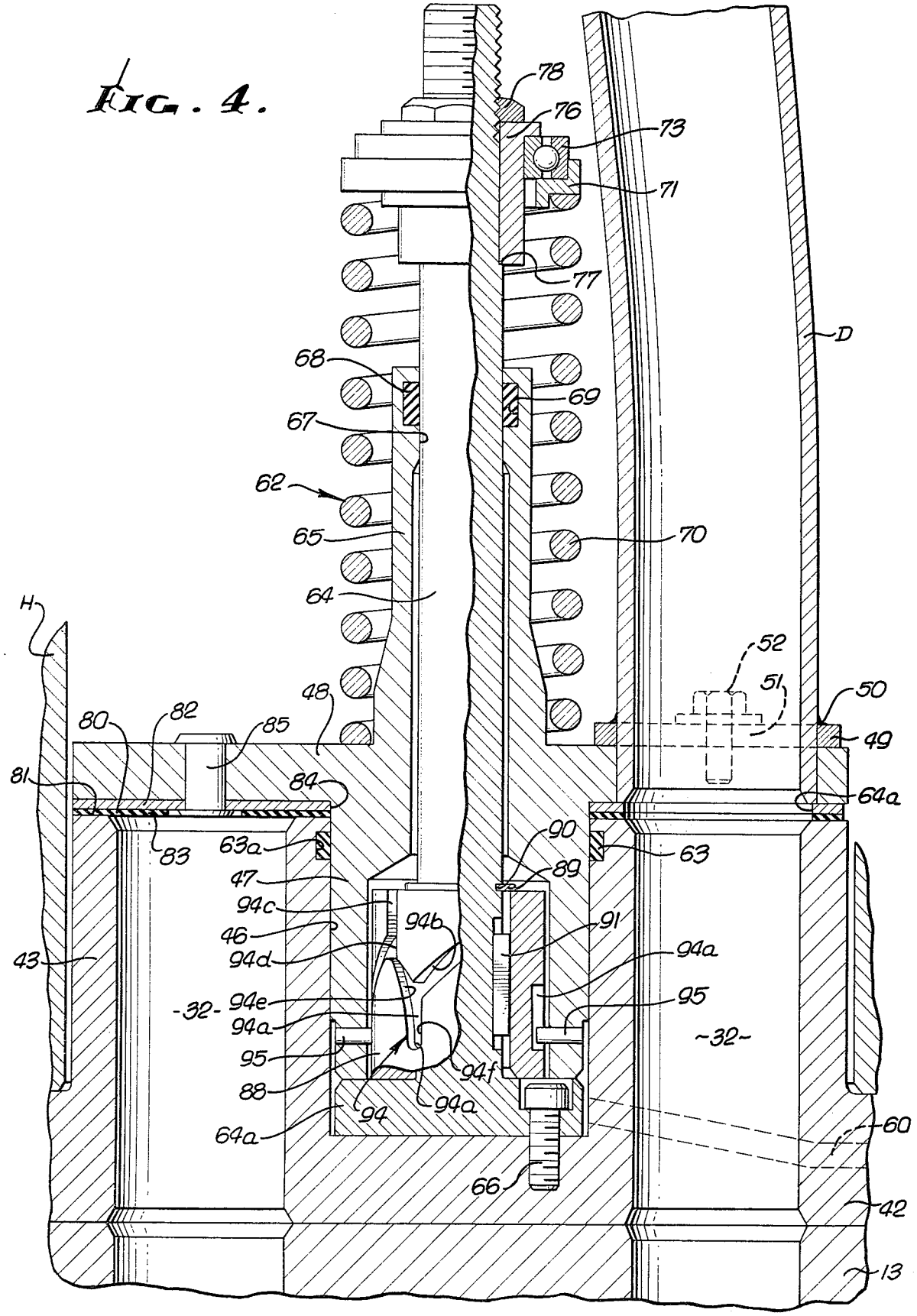
FIG. 4 is a further enlarged fragmentary section, with parts broken away, showing the TFL selector indexing structure.

As seen in FIGS. 3 and 4, the selector S for through the flowline well tools comprises a hollow pressure vessel or housing H of elongated form in which a diverter tube D is disposed for selective communication between a single passage 30 in a connector flange 31, at the upper end of the housing, and a selected flowline port 32, of a number of circumferentially and equally spaced flowline ports, at the lower end of the housing, whereby TFL tools can be pumped through the diverter tube from the loop 12 and through the selected flowline port 32. The housing H and the diverter tube D are longitudinally extended so that the diverter tube D is sufficiently long that the curvature or lateral offset therein does not interfere with the free movement of TFL tools therethrough.

The housing H has an end flange 33 secured as by studs 34 to the connector 31. A sealing ring 36, or other suitable sealing means, is disposed in opposed grooves in the connector 31 and the flange 33 and is clamped therebetween. At its lower end, the housing H has a flange 37, secured by studs 38 and nuts 39 to the connector body section 13. The studs 38 also extend through holes 41 in an outwardly projecting flange 42 of a base member 43 which has the flowline ports 32 therethrough communicating and aligned with the passages 23 in the connector C. Suitable sealing rings 44 and 45 are disposed between the housing flange 37 and the base member flange 42, as well as between the flange 42 and the connector body 13 to prevent leakage of fluid therebetween.

Actuator means are provided for effecting the selective positioning of the diverter tube D to establish communication between the single port 30 in the end connector 31 and one of the plural flow ports 32 in the base member 43. Such actuator means generally comprises a central cylinder 46 in which is reciprocably disposed an actuator piston 47. At the outer end of the actuator piston 47 is an outwardly projecting plate or flange 48, to which the inner end of the diverter tube D is connected by suitable means such as a disc member 49 welded at 50 to the diverter tube D and having opposed outstandindg ears 51 fastened to the piston flange 48 by suitable fasteners 52. Thus, the diverter tube D is reciprocable with the piston 27.

Accordingly, at the other end of the diverter tube D is an elongated cylindrical section 53 which slidably extends into a bushing 54 disposed in a bore in the housing H between shoulders provided by the connector and housing. In order to prevent the intrusion of particles between the opposing cylindrical surfaces provided by the diverter tube and within the bushing, a suitable sealing or wiping ring 58 is disposed in the bushing 54, so as to wipe the cylindrical diverter tube section as it reciprocates within the bushing. Between the cylindrical section 53 of the diverter tube D and the other end thereof the diverter tube is arched laterally, whereby the inner end thereof can be brought into alignment with the circumferentially spaced flowline ports 32 in the base member 43, as will be later described, and so as to not interfere with the freedom of motion of the usual through the flowline tools through the diverter tube.

The actuator means for diverter D are adapted to effect reciprocation of the piston 47 by the application of pressure fluid to the cylinder 46 through a suitable passageway 60 which extends through the flange 42 of the base member 43 between the cylinder 46 and the outer periphery of the flange 42, where the flange 42 is adapted to receive a suitable pressure fluid conduit 61 which extends upwardly to the vessel or platform to a pressure source. When the cylinder 46 is pressurized to shift the piston 47 outwardly with respect to the cylinder 26, the piston compresses spring means 62 adapted to store energy, whereby to effect the opposite or return movement of the piston. As will be later described, such reciprocation of the piston under the influence of pressure fluid and the spring effects indexing of the diverter tube D, and, as will also be later described, fluid pressure within the housing H supplements the force of the spring means 62 tending to cause the return stroke of the piston 47.

The structure of the actuator means for the diverter may be best understood by reference to FIGS. 4 and 5. More particularly, the base member 43 has the cylinder 46 located coaxially thereof, the the actuator piston 47 extends into the cylinder 46 from the piston flange 48. A suitable sealing or piston ring 63 disposed in an annular groove 63*a* in the cylinder wall provides a pressure seal to confine the pressure fluid supplied through the passage 60 to the cylinder 46.

A post 64 has an enlarged base 64*a* secured as by screws 66 to the inner end of the cylinder 46, the post extending coaxially through the piston 47, the piston flange 48 and an elongated tubular neck 65 which is formed or fixed to and extends coaxially outwardly from the piston flange 48. At its outer extremity, the neck 65 has a cylindrical bore 67 through which the post 64 extends, and within the bore 67 a sealing ring or packing 68 received in a groove 69 within the neck 45 separates the actuator cylinder 46 from the interior of the housing H.

The return spring means 62 previously referred to, which causes return movement of the piston, comprises a coiled compression spring 70 which seats at one end against the piston flange 48 and is disposed about the neck 65. At its other end, the coiled spring 70 engages a seat 71 of annular form which receives the ball bearing assembly 73 having an inner race which shoulders beneath an end flange of a bearing support sleeve 76 which is disposed on the outer end of the post 64 and secured in place, between an inner shoulder 77, on the post 64, and a nut 78 which is threaded upon the threaded outer end of the post 64. Thus, while the spring 70 can act between the seat 71 and the piston flange 48 to urge the piston 47 inwardly of the cylinder 46, the entire piston and spring assembly is free to revolve relative to the post 64 by virtue of the mounting of the outer spring seat 71 in the bearing means carried by the post 64.

As best seen in FIG. 4, seal plate means 80 is interposed between the piston flange 48 and the outer end surface 81 of the member 43 defining the flowline ports 32, so that when the diverter tube D is in communication with a selected one of the flowline ports, the seal plate means 80 can prevent the accumulation of sediment between the multiple flowline ports. However, the seal plate means is not needed to prevent fluid flow between ports 32, since such flow is prevented by the flowline valves (not shown) of units V which are more specifically illustrated in my patent application, Ser. No. 854,785 filed Nov. 25, 1977. This seal means comprises a circular support disc or plate 82 having bonded thereto an elastomeric disc 83. The supporting plate and the sealing disc have a central opening 84 through which the piston 47 projects and at a location radially spaced from the axis of the piston, the sealing disc assembly 80 has a port **64*a* aligned with the end of the diverter tube D, as seen in FIG. 4, for the passage of fluid and through the flowline tools between the diverter tube D and a selected flowline port 32. The sealing disc assembly 80 is suitably secured to the piston flange 48 by rivets 85 or other suitable fasteners. Such rivets 85 are spaced circumferentially so as to lie substantially centrally of the equally spaced flowline ports 32 in the base member 43**.

Cam means are provided for rotating the piston 47, and thus the diverter tube D, in response to reciprocation of the actuator piston, to successively align the diverter tube D with a selected flowline port 32. Such cam means are best seen in FIGS. 4 and 5. The cam means comprises a cam sleeve 88 which is disposed about the post 64 and held between the base 65 of the post and a suitable lock ring 89 engaged in a groove 90 in the post and overlying the end of the cam sleeve. Precise orientation of the cam sleeve 88 with respect to the base member 43 and thus with respect to the flowline ports 32 is accomplished by means of a key 91 engaged in opposing keyways extending longitudinally of the post 64 and the cam sleeve 88. Formed in the cam sleeve 88 is what may be considered to be a continuous cam track generally indicated at 94 in which cam follower means in the form of radially projecting pins 95, carried by the piston 47, are engaged. The cam track is formed so that as the piston 47 receprocates, the piston, and consequently the diverter tube D, will be caused to rotate from a location at which the diverter tube D is in communication with an adjacent flowline port 32.

As seen in FIG. 5, the piston 47 carries a plurality of circumferentially spaced cam follower pins 95 each of which extends into a corresponding formation of the cam slots 94. However, it will be apparent that while such a structure is preferred from the standpoint of strength, fewer cam follower pins may be employed, if desired. A typical formation of the cam track involves a vertical track section **94*a* in which a follower pin 95 is disposed when the piston 47 is in a fully retracted condition. Upon outward movement of the piston, the cam follower pins 95 will encounter an angularly extended cam wall 94*b* which extends circumferentially from a location at the side of the center of vertical section 94, to a location at the near side of an upper vertical section 94*c* of the cam track, into which the cam follower 95 will be moved upon continued outward movement of the piston 47, during a first increment of angular motion of the piston, caused by coengagement of the cam follower 95 with the angular wall 94*b*. The vertical cam track section 94*c* has a vertical wall 94*d* which extends into confronting relation to the center of the cam track below the wall 94*b*, to cause the follower 95 to move into the vertical track section 94*c* responsive to upward movement of the piston relative to the stationary cam sleeve 88. As the piston motion is reversed and the piston is moving downwardly with respect to the cam sleeve 88, the follower 95 will encounter a cam wall 94*c* which extends downwardly at an angle and circumferentially of the cam sleeve from a location to the left of the center of the vertical track section 94*c*, downwardly to the next vertical track section 94*a*. The track section 94*a* has a vertical wall 94*f* confronting the follower 95, as it moves downwardly along the wall 94*c*, to cause the follower to move into the vertical track section 94*a*. Thus, the piston is caused to move through an increment of angular motion as the piston is projected from the cylinder 46 and through a second increment of motion as the piston is projected from the cylinder 46 and through a second increment of motion as the piston is moving back into the cylinder on the reverse stroke. The two increments of angular motion combine to cause a total angular motion such that the diverter tube D will be caused to move from one of the flowline ports 32** to the adjacent flowline port. However, if it is desired that the diverter tube D be aligned with another of the angularly spaced flowline ports, then it is only necessary to cycle the actuator means a sufficient number of cycles to angularly shift the diverter tube D to the selected flowline port.

In the event that the spring means 62 for some reason fails to exert sufficient force on the piston 47 to displace pressure fluid from the cylinder 46 and to cause inward movement of the piston, so that the piston flange 48 is fully seated, it will be understood that the pressure of fluid in the sealed housing H also provides a force acting on the exposed piston area to move the piston inwardly.

The connector C may be any desired type enabling remote coupling of the upper body section 13 with the lower body section 19, with the flow passages 32 in the former and 23 in the latter aligned. Preferably, however, the connector is of the type more specifically illustrated and described in U.S. Pat. No. 3,321,217 granted May 23, 1967 to A. G. Ahlstone for "Coupling Apparatus for Wellheads and The Like". Such a connector includes locking means generally denoted 200 and actuator means generally denoted 201 operable from the drilling vessel or platform atop the water to lock the upper body section 13 of the connector to the lower body section or post 19, after the upper body section has been stabbed over the lower section. In order to form a fluid tight joint between the upper and lower body sections, a metal deformable ring gasket 202 is interposed between the opposing transverse portions of the upper and lower bodies, the ring gasket 202, as is customary of such gaskets, seating in a downwardly opening groove 203 in the upper body section 13 and in an upwardly facing groove 204 in the lower body section 19, and being preloaded into metal-to-metal sealing contact with the opposed angular faces 205 and 206 forming the outer periphery of the respective grooves. The ring gasket 202 may be initially retained in place with respect to the upper body section as disclosed in the above-identified Ahlstone United States Patent, or the ring gasket may be initially held in position for sealing and preloading engagement between the body sections as disclosed in the pending application of Ahlstone, Ser. No. 804,584, filed June 8, 1977 for "Flexible Ring Gasket Retainer for Flanged Connectors".

The actuator means 201 comprises an annular body section 227 supported beneath an upper body flange 207 on a cylindrical body section 228 which is connected to the flange by means of a suitable number of circumferentially spaced screw fasteners 229. In the annular body section 227 is a suitable number of circumferentially spaced piston and cylinder actuators comprising a cylinder 230 providing a piston chamber 231 in which a piston 232 is reciprocable, the piston 232 having a rod 233 connected to a wedge ring 234 of the locking means 200. The cylinder member 230 is disposed within a bore 235 in the body section 227 and has an external side ring seal 236 for preventing the bypass of pressure fluid about the cylinder. At the upper end of the bore 235 is an upper cylinder head member 237 having an external side ring seal 238 engaged within the bore 235 and an internal side ring seal 239 slidably and sealingly engaged with the piston rod 233. At the lower end of the cylinder 230 is a lower cylinder head and retainer plug 240 having a side ring seal 241 engaged within the bore 235 the head member 240 being secured to the body section 227 by suitable fastenings 242. Actuating pressure fluid is adapted to be supplied to the piston chamber 231 and exhausted therefrom above and below the piston 232 by a passage means in the body structure shown as passages 243 and 244 respectively communicating with annular spaces 245 and 246 defined between the exterior of the cylinder sleeve 230 and the wall of the bore 235. These spaces 245 and 246 respectively communicate with the piston chamber 231 through appropriate radial slot or slots 247 in the upper head 237 and 248 in the lower head 240, and the piston 232 has a side ring seal or piston ring 249 which prevents leakage around the piston. As is well known in connection with double acting actuator cylinders, the ports 243 and 244 can alternately function as inlet or exhaust ports. If desired, however, the actuator cylinder means of the present invention can be constructed in accordance with prior U.S. Pat. No. 3,321,217, wherein primary and secondary actuator cylinders are employed to assure release of the connector. Actuator fluid is supplied and exhausted through suitable conduits 243*a* and 244*a* which extend to the vessel or platform for remote operation of the locking means.

The actuator piston rod 233 has a threaded connection 250 with a connecting screw 251 which is threaded into the wedge ring 234, whereby reciprocation of the piston will effect axial movement of the wedge ring 234. Such axial movement of the wedge ring is adapted to cause locking movement of the locking means 200 with respect to the connector structure 19 to the inwardly projected position shown in FIG. 3.

The locking means 200 comprises a plurality of arcuate locking dog segments 253 shiftably disposed in a circumferentially extended window in the body structure between a downwardly facing upper shoulder 254 provided by the top flange 207 and a lower upwardly facing shoulder 255 provided on the annular body member 227. The dog segments 253 in such connectors are normally spring loaded away from one another and therefore relatively outwardly by suitable springs. As disclosed in U.S. Pat. No. 3,321,217 so that the dog segments can be wedged inwardly by the wedge ring 234 upon actuation of the actuator means 201. In this connection, it will be seen that the wedge ring 234 has an internal surface 259 which is inclined downwardly and outwardly and is adapted to engage external downwardly and outwardly inclined outer surfaces 260 on the locking dog segments 253.

The interior of the locking dog segments 253 and the exterior of the body 19 are formed to cooperatively interlock the connector parts together and apply an axial loading force to the connector. More particularly, the interior of the locking dogs provide vertically spaced and circumferentially extended ribs 272 and grooves 273, with the crests of the ribs being of gradually diminishing diameter from bottom to top. The exterior of the locking body 19 has companion ribs 274 and grooves 275, with the crests of the ribs also gradually diminishing in diameter from bottom to top. When the connector parts are initially stabbed together, with the wedge ring 234 in the upper position, the body 19 can pass axially between the locking dog segments 253, until the upper end of the body 19 is disposed in the body bore 270 and the seal 202 is deformed. Thereafter, in response to the application of pressure fluid to the actuator cylinder chamber 231 above the respective pistons 232, the wedge ring 234 is moved downwardly, wedging the locking dog segments 253 inwardly, causing the upper flanks of the ribs 272 on the dog segments to engage the lower flanks of the ribs 274 on the body section 19, whereby to apply an axial camming action forcing the upper body into engagement with the body section thereby loading the seal ring 202.

When the actuator means 201 are pressurized to shift the wedge ring 234 upwardly from the position of FIG. 3, the locking dog segments 253 are again retractible to enable the connector C to be disconnected, so that the TFL apparatus can be retrieved by a tool engaged in the funnel structure 14.

Referring to FIG. 6, it will be seen that a slip joint is provided by the connector means A between the inlet conduit and the inlet or access loop 12. Connected to the upper template structure 11 is an upwardly opening spear 300 forming the end of the inlet I. Carried by a bracket 301 on the connector body 13 is a packing or sealing unit 302 of suitable construction adapted to mate with and form a fluid tight seal about the spear 300. As shown, the seal unit is a body 303 having a bore 304 receiving chevron packing 305 retained by a gland 306 threaded into the body. The packing seals with the spear when the connection A is stabbed together. Other sealed joints may be employed, such as a remotely pressurized seal, if necessary to withstand high pressure.

Also associated with the housing or body section 113 of connector C is additional means 400 to assist in orienting the upper body and lower body of the connector to assure alignment of the internal ports. As seen in FIG. 2, a peg 401 supported on the template structure 11 projects upwardly into a conical depression or seat 402 in a bracket 403 on the connector body 13. Engagement of the peg with the inclined surface of the seat helps assure the alignment of the structure.

In the use of the apparatus described above, it will now be recognized that with the subsea template T, having the lower connected body section 19 secured thereto and the respective inlet conduit I and flowlines F connected with the selected valve units or with an in-series TFL selector, the upper connector body section 13, the TFL selector S, the access loop 12, and the handling funnel 14 can all be lowered on a running and manipulating pipe from the vessel or platform, through the water to the template T, either while guided by guidelines 15 or otherwise guided and controlled. The connector C as well as the access connector A can be landed upon the template and the connector C locked in assembled relation by the application of pressure fluid through the conduit 243*a*. Alignment of the ports 32 in the TFL selector and the ports 23 in the connector body 19 is assured by the alignment means. Thereafter the application of pressure fluid through the conduit 61 to actuate the indexing means of the TFL selector will be affective to establish a flowline connection between the selected flowline F and the access conduit or loop 12. When it is desired to retrieve the upper connector section and the TFL selector, it is only necessary to reconnect a retrieval tool with the funnel structure 14 and apply lock releasing fluid pressure through the conduit 244*a* to the connector locking structure.

Thus, the invention provides a novel and simple apparatus, whereby the TFL selector can be made up or assembled with flowlines and an inlet conduit from a remote location and at substantial depth in the water below a level at which a diver may operate and without need for a complicated subsea manipulator or diving bell equipment.

I claim:

1. Through the flowline apparatus for wells completed on the floor of a body of water comprising: a template having wellhead means thereon; through the flowline selector means on said template; a plurality of flowlines extending between said selector means and said wellhead means; an inlet conduit connected to said template; said selector means having an access loop connected with said inlet conduit and remotely operable means for selectively establishing communication between said access loop and one of said flowlines; and means releasably connecting said selector means and said access loop to said template including remotely operable connector means.

2. Through the flowline apparatus as defined in claim 1; including second selector means having said access loop and said remotely operable means; one of said flowlines being connected with said access loop of said second selector means, additional flowlines communicating between said second selector means and said wellhead means, and means releasably connecting said second selector means and its access loop to said template including additional remotely operable connector means.

3. Through the flowline apparatus as defined in claim 1; said remotely operable connector means including fluid pressure operated locking means for holding said connector means against release.

4. Through the flowline apparatus as defined in claim 1; said means releasably connecting said selector means and said access loop to said template including a sealed stab joint between said access loop and said inlet conduit.

5. Through the flowline apparatus as defined in claim 1; said means releasably connecting said selector means and said access loop to said template including a sealed stab joint between said access loop and said inlet conduit; and means for aligning said slip joint and said selector means with said inlet and said flowlines.

6. Through the flowline apparatus as defined in claim 1; said connector means including a first connector body section on said template having ports communicating with said flowlines, a second connector body section connected with said selector means, said body sections being complementally engageable; and means for locking said body sections together.

7. Through the flowline apparatus as defined in claim 1; said connector means including a first connector body section on said template having ports communicating with said flowlines, a second connector body section connected with said selector means, said body sections being complementally engageable; and means for locking said body sections together, and including means on said second body section and said template for aligning said inlet and said access loop and said selector means with respect to said template and said first body section upon connection of said connector means.

8. Through the flowline apparatus as defined in claim 1; said connector means including a first body section vertically disposed on said template and having ports communicating with said flowlines, a second body section connected with said selector means vertically engageable with said first body section, and means for locking said body sections together.

9. Through the flowlines apparatus as defined in claim 1; said connector means including a first body section vertically disposed on said template and having ports communicating with said flowlines, a second body section connected with said selector means vertically engageable with said first body section, and means for locking said body sections together, said means releasably connecting said selector means and said access loop to said template including a sealed stab joint between said access loop and said inlet conduit.

10. Through the flowline apparatus as defined in claim 1; said connector means including a first body section vertically disposed on said template and having ports communicating with said flowlines, a second body section connected with said selector means vertically engageable with said first body section, and means for locking said body section together, said means releasably connecting said selector means and said access loop to said template including a sealed stab joint between said access loop and said inlet conduit, and means connected with said selector means and said second body section and engageable by a running tool for lowering said selector means and said second body section onto said template through a body of water.

11. Through the flowline apparatus as defined in claim 10, including guideline means for guiding said second body section onto said first body section and said stab joint into engagement.

12. Through the flowline apparatus for wells completed on the floor of a body of water and including a template having wellhead means thereon with flowlines connected with said wellhead means, said apparatus comprising: through the flowline selector means including an access opening and a plurality of ports selectively communicable with said access opening; a connector body section connected with said selector means; another connector body section having ports therein and connectable to said template with the ports therein communicable with said flowlines; and remotely operable means for interconnecting said body sections together.

13. Through the flowline apparatus as defined in claim 12 said another body section having locking elements thereon, said body section connected to said selector means having an opening therein for receiving said another body section and locking means releasably engageable with said locking elements.

14. Through the flowline apparatus as defined in claim 13; including fluid pressure operated means for actuating said locking means into engagement with said locking elements.

15. Through the flowline apparatus as defined in claim 13; said locking elements being circumferentially extended axially spaced ribs on said another body section, and said locking means being dogs having ribs engageable with said ribs of said locking elements.

16. Through the flowline apparatus as defined in claim 13; said locking elements being circumferentially extended axially spaced ribs on said another body section, and said locking means being dogs having ribs engageable with said ribs of said locking elements, and fluid pressure operated wedge means for forcing said dogs into locking engagement with said ribs of said locking elements.

17. Through the flowline apparatus as defined in claim 12; including handling means connected with said selector means for connection with a running tool.

18. Through the flowline apparatus as defined in claim 12; including an access loop connected with said access opening and having connector means sealingly engageable with an inlet on said template.

19. A through the flowline connector comprising: a male connector post having a plurality of circumferentially spaced ports extending longitudinally therethrough and opening through the extremity of said post; a female connector body axially engageable over and surrounding said post and having an end wall confronting said extremity of said post and provided with a plurality of openings in alignment with and communicable with said ports; a seal between and engaging said post and said end wall extending externally of and around said ports and openings; and remotely operable fluid pressure operated locking means for holding said body on said post.

20. A through the flowline connector comprising: a male connector post having a plurality of circumferentially spaced ports extending longitudinally therethrough; a female connector body axially engageable over said post and having an end wall provided with a plurality of openings communicable with said ports; a seal between said post and said end wall extending about said ports and openings; and remotely operable fluid pressure operated locking means for holding said body on said post, including through the flowline selector means connected to said end wall and having a base provided with a plurality of ports therein in communication with said openings in said end wall, a housing on said base having an inlet, diverter means in said housing communicating with said inlet and shiftable to establish communication between said inlet and a selector port in said base, and remotely operable means for shifting said diverter means.

21. The method of installing underwater through the flowline selector apparatus comprising: providing on an underwater template containing wellhead means, plural flowlines communicating with said wellhead means and an inlet conduit, a connector body section having plural ports communicating with said flowlines, lowering another connector body section and a through the flowline selector through the water; moving said body sections into engagement with one another and establishing communication between said inlet conduit and said flowline through said selector; and locking said body sections together.

22. The method of claim 21, the first mentioned connector body section extending vertically from said template, and said second mentioned connector body section being stabbed vertically to engage said body sections.

23. The method of claim 21, the first mentioned connector body section extending vertically from said template, and said second mentioned connector body section being stabbed vertically to engage said body sections, and including hydraulically locking said body sections together.

24. Through the flowline apparatus for wells completed on the floor of a body of water comprising: a template having wellhead means thereon; through the flowline selector means on said template; a plurality of flowlines extending between said selector means and said wellhead means; an inlet conduit connected to said template; an access loop connected with said inlet conduit and said selector means; said selector means having a diverter tube connected with said access loop; and remotely operable means for selectively establishing communication between said diverter tube and one of said flowlines; and means releasably connecting said selector means to said template including remotely operable connector means.

25. Through the flowline apparatus as defined in claim 24; including second selector means having said diverter tube and said remotely operable means, one of said flowlines being connected with said diverter tube of said second selector means, additional flowlines communicating between said second selector means and said wellhead means, and means releasably connecting said second selector means to said template including additional remotely operable connector means.

26. Through the flowline apparatus as defined in claim 24; said remotely operable connector means including fluid pressure operated locking means for holding said connector means against release.

27. Through the flowline apparatus as defined in claim 24; said means releasably connecting said selector means to said template including a sealed stab joint between said access loop and said inlet conduit.

28. Through the flowline apparatus as defined in claim 24; said means releasably connecting said selector means and said access loop to said template including a sealed stab joint between said access loop and said inlet conduit; and means for aligning said slip joint and said selector means with said inlet and said flowlines.

29. Through the flowline apparatus as defined in claim 24; said connector means including a first connector body section on said template having ports communicating with said flowlines, a second connector body section connected with said selector means, said body sections being complementally engageable; and means for locking said body sections together.

* * * * *